US009004946B2

(12) United States Patent
Hoeppner

(10) Patent No.: US 9,004,946 B2
(45) Date of Patent: Apr. 14, 2015

(54) ELECTRICAL CONNECTOR, ELECTRICAL MATING CONNECTOR, ELECTRICAL PLUG CONNECTION AS WELL AS ASSEMBLED ELECTRICAL CABLE

(75) Inventor: Ulf Hoeppner, Bammental (DE)

(73) Assignee: Tyco Electronics AMP GmbH, Bensheim (DE)

( * ) Notice: Subject to any disclaimer, the term of this patent is extended or adjusted under 35 U.S.C. 154(b) by 62 days.

(21) Appl. No.: 13/583,424

(22) PCT Filed: Feb. 28, 2011

(86) PCT No.: PCT/EP2011/052882

§ 371 (c)(1),
(2), (4) Date: Sep. 7, 2012

(87) PCT Pub. No.: WO2011/110434

PCT Pub. Date: Sep. 15, 2011

(65) Prior Publication Data

US 2012/0329324 A1 Dec. 27, 2012

(30) Foreign Application Priority Data

Mar. 9, 2010 (DE) ..... 10 2010 002 681

(51) Int. Cl.

| | |
|---|---|
| ***H01R 9/03*** | (2006.01) |
| ***H01R 13/6583*** | (2011.01) |
| ***H01R 13/53*** | (2006.01) |
| ***H01R 13/645*** | (2006.01) |

(52) U.S. Cl.

CPC ..... *H01R 13/6583* (2013.01); *H01R 13/53* (2013.01); *H01R 13/6456* (2013.01); *H01R 2201/26* (2013.01)

(58) Field of Classification Search

USPC ..... 439/607.01, 607.41, 607.42, 607.43, 439/607.44, 607.45

See application file for complete search history.

(56) References Cited

U.S. PATENT DOCUMENTS

| | | | | |
|---|---|---|---|---|
| 5,518,421 | A | 5/1996 | Davis | |
| 5,908,331 | A | 6/1999 | Hsu et al. | |
| 6,086,421 | A * | 7/2000 | Wu et al. | 439/607.35 |
| 6,113,427 | A * | 9/2000 | Wu | 439/607.47 |

(Continued)

FOREIGN PATENT DOCUMENTS

| | | |
|---|---|---|
| DE | 69417780 T2 | 11/1999 |
| DE | 69331959 T2 | 11/2002 |

(Continued)

OTHER PUBLICATIONS

International Search Report and Written Opinion issued by the European Patent Office, dated May 30, 2011, for related International Application No. PCT/EP2011/052882; 12 pages.

(Continued)

*Primary Examiner* — Hae Moon Hyeon

(74) *Attorney, Agent, or Firm* — Faegre Baker Daniels LLP

(57) ABSTRACT

Electrical plug-and-socket connector, electrical mating connector, electrical plug-in connection and made-up electric cable. The disclosure relates to an electrical plug-and-socket connector, in particular electrical pin socket, with a plug-and-socket connector body and electromagnetic shielding provided on the plug-and-socket connector body, the plug-and-socket connector body and the shielding having coding means which correspond to each other, by means of which the shielding is provided in a certain orientation on the plug-and-socket connector body.

11 Claims, 4 Drawing Sheets

(56) References Cited

U.S. PATENT DOCUMENTS

| | | | | |
|---|---|---|---|---|
| 6,139,367 | A | 10/2000 | Yeh | |
| 6,322,394 | B1 * | 11/2001 | Katoh et al. | 439/607.11 |
| 6,835,091 | B2 * | 12/2004 | Oleynick et al. | 439/541.5 |
| 7,165,989 | B2 * | 1/2007 | Huang et al. | 439/346 |
| 7,540,772 | B2 * | 6/2009 | Sardi et al. | 439/581 |
| 2002/0173184 | A1 | 11/2002 | Miyazaki | |
| 2003/0220021 | A1 | 11/2003 | Whiteman, Jr. et al. | |
| 2005/0221673 | A1 * | 10/2005 | Myer et al. | 439/607 |
| 2005/0227537 | A1 * | 10/2005 | Peng | 439/607 |
| 2005/0255752 | A1 * | 11/2005 | Huang | 439/607 |
| 2006/0019539 | A1 | 1/2006 | Ishizaki et al. | |
| 2008/0026639 | A1 * | 1/2008 | Sardi et al. | 439/610 |
| 2013/0029526 | A1 * | 1/2013 | Berger et al. | 439/607.41 |
| 2013/0323954 | A1 * | 12/2013 | Eckel et al. | 439/271 |

FOREIGN PATENT DOCUMENTS

| | | | |
|---|---|---|---|
| EP | 0587303 | A2 | 3/1994 |
| EP | 1883135 | A1 | 1/2008 |
| EP | 2020708 | A1 | 2/2009 |
| WO | WO 2008/109109 | A1 | 9/2008 |

OTHER PUBLICATIONS

German Search Report dated Feb. 17, 2011, for related German Application No. 10 2010 002 681.6; 5 pages.

Internatioal Preliminary Report on Patentability issued by The International Bureau of WIPO, Geneva, Switzerland, dated Sep. 11, 2012, for related International Application No. PCT/EP2011/052882; 7 pages.

* cited by examiner

ELECTRICAL CONNECTOR, ELECTRICAL MATING CONNECTOR, ELECTRICAL PLUG CONNECTION AS WELL AS ASSEMBLED ELECTRICAL CABLE

BACKGROUND

The invention relates to an electrical plug-and-socket connector, in particular a pin socket, and an electrical mating connector or plug-and-socket connector, in particular a female connector, which have in each case a plug-and-socket connector body and electromagnetic shielding provided on the plug-and-socket connector body. Furthermore, the invention relates to an electrical plug-in connection, in particular for the automotive sector, with a plug-and-socket connector according to the invention and a plug-and-socket connector which corresponds thereto. Furthermore, the invention relates to a made-up electric cable, in particular for the automotive sector, with a plug-and-socket connector according to the invention.

In the field of electrical engineering, a large number of electrical pin connectors and female connectors—referred to below as (electrical) plug-and-socket connectors—are known which serve to transmit electric power, i.e. high electric currents and/or voltages, and/or electrical signals with a maximum possible range of voltages, currents, frequencies and data rates. In particular in the automotive sector, electrical plug-and-socket connectors have to permanently ensure perfectly satisfactory transmission of electric power and electrical signals in dirty, damp and/or chemically aggressive environments. Owing to the great range of applications for such plug-and-socket connectors, a large number of specially configured plug-and-socket connectors are known.

One relatively new field in the application of electrical plug-and-socket connectors is the transmission of comparatively high amounts of electrical drive and/or braking energy in a (partially) electrically powered motor vehicle. The drive and/or braking energy of the motor vehicle has to be transmitted between an energy store such as a battery or an energy source, such as a fuel cell, and a converter, such as a two-quadrant or four-quadrant converter, in one or both directions. Between the energy source and the converter, the electric power is mostly transmitted in the form of direct current. Between the converter and the drive motor or motors, the electric power is mostly transmitted by means of alternating current, e.g. a three-phase alternating current.

Further, high electrical voltages and/or currents occur in the automotive sector, e.g. upon the controlling of the braking interventions by an anti-lock braking system (ABS) or an electronic stability program (ESP) or upon supplying power to an electromechanical brake. Very generally, high electrical voltages and/or currents occur in power electronics, the high voltages and/or currents having to be transported by means of suitable plug-and-socket connectors and cables from an energy store or an energy source to the power electronics and possibly also back again.

Spurious electromagnetic signals are generated in particular by alternating currents and the rising and falling of high direct-current voltages, which signals may interfere with sensitive electronics in an electric or electronic control means, such as an engine control unit (ECU) or in a control device within the motor vehicle. For this, the control means or the control devices are provided with corresponding electromagnetic shieldings. Due to constantly increasing electrification of motor vehicles, more and more spurious electromagnetic signals are being generated, which makes higher and higher demands on the shieldings of the control means or control devices. Therefore not only the control means or control devices, but also relevant cables and their plug-and-socket connectors, are shielded.

That is to say that relevant plug-and-socket connectors have electromagnetic shielding, which can be electrically contacted by a mating connector. Contacting of the shielding of the plug-and-socket connector mostly takes place by resilient electrical contact arms of the shielding of the mating connector. What is problematic with such contacting are folds in the shielding of the plug-and-socket connector, since these double the thickness of the shielding and cause problems with the contacting with the mating connector, which has an effect in particular on the durability of the plug-in connection which is to be established or on the durability of the mating connector. Further, shieldings, the contact tabs of which effect fastening of the shielding to an appropriate plug-and-socket connector body, cause problems.

SUMMARY

It is an object of the invention to make available an improved electrical plug-and-socket connector; an improved plug-and-socket connector which corresponds thereto; an improved plug-in connection and an improved made-up cable. In this case, the plug-and-socket connector should be configured such that a plug-in connection which is to be equipped therewith has good durability. In particular, when correctly equipping a plug-in connection with the plug-and-socket connector, electrical shield contacts of a plug-and-socket connector which corresponds thereto, should not suffer any damage. Furthermore, robust and permanent seating of the shielding on the plug-and-socket connector should be brought about.

The object of the invention is achieved by means of an electrical plug-and-socket connector, in particular a pin socket, according to claim 1; an electrical mating connector or plug-and-socket connector, in particular a female connector, according to claim 10; an electrical plug-in connection, in particular for the automotive sector, according to claim 11; and a made-up electric cable, in particular for the automotive sector, according to claim 12. Advantageous developments of the invention will become apparent from the dependent claims.

An electrical plug-and-socket connector according to the invention has a plug-and-socket connector body and electromagnetic shielding arranged on the plug-and-socket connector body. The plug-and-socket connector body and the shielding have coding means which correspond to each other, by means of which the shielding can be provided in a given position on the plug-and-socket connector body. Preferably, in this case, at least some of the coding means which correspond to each other effect fastening of the shielding to the plug-and-socket connector body. Further, it is preferred for the coding means which correspond to each other to be arranged such that a fold in the shielding upon mounting the shielding attains a certain position relative to the plug-and-socket connector body. In this case, in particular only a single position, or a plurality of positions of the shielding which are point-symmetrical or mirror-symmetrical to each other relative to the plug-and-socket connector body, is possible.

According to the invention, the shielding of the plug-and-socket connector, and hence also a fold in the shielding which may possibly be present, attains a defined position with respect to the plug-and-socket connector body. If then the plug-and-socket connector is assembled in a certain orientation with a plug-and-socket connector which corresponds thereto, i.e. a mating connector, the shielding of the plug-and-socket connector adopts a certain position or orientation relative to the corresponding plug-and-socket connector. According to the invention, it is therefore possible to match the corresponding plug-and-socket connector or the shielding thereof to a shielding of the plug-and-socket connector, and vice versa. A required correct orientation of the plug-and-socket connector relative to the corresponding plug-and-socket connector and to the shielding on/in the corresponding plug-and-socket connector may be effected e.g. in each case by means of a corresponding coding.

This is important in particular for a fold in the shielding of the plug-and-socket connector, since said fold doubles a wall of the shielding, which due to a small available installation space has effects on electrical contacting with the shielding of the corresponding plug-and-socket connector. In this case it is preferred that when the two plug-and-socket connectors are assembled correctly the shielding of the corresponding plug-and-socket connector is positioned (see above) and formed (see also below) such that the fold in the shielding of the plug-and-socket connector is not intentionally electrically contacted. That is to say that the shielding of the corresponding plug-and-socket connector does not have a corresponding device or means, such as a resilient contact arm or a resilient contact arm arrangement, at the relevant position.

Therefore a plug-in connection to be equipped with the plug-and-socket connector according to the invention has good durability, since electrical contact arms or contact arm arrangements of the shielding of the corresponding plug-and-socket connector do not contact the fold in the shielding of the plug-and-socket connector mechanically. That is to say that during equipping and later during use of a plug-in connection consisting of a plug-and-socket connector and corresponding plug-and-socket connector, the shield contacts, in particular resilient contact arms or contact arm arrangements, of the corresponding plug-and-socket connector do not suffer any damage.

In a first example of embodiment, coding means which correspond to each other are a coding rib or a projection, and a coding slot or a groove. In this case, the coding rib or the projection is preferably provided on the plug-and-socket connector body, and the coding slot or the groove which corresponds thereto is preferably provided in the shielding. In this case, in particular a plurality of such coding means which correspond to each another is provided, it being preferred for these, apart from one or two positions, to be provided regularly on a periphery of a receptacle of the plug-and-socket connector body for the shielding and a periphery of the shielding. In this case it is preferred for the coding means of the shielding to act as a fastening for the shielding on/to the plug-and-socket connector body. That is to say that the coding means of the shielding form a fixing means of the shielding to/on the plug-and-socket connector body, with coding slots also serving as fastening slots or grooves also serving as fastening grooves.

Further, in a second example of embodiment, coding means which correspond to each other may be a recess or a cutaway, and a material section or a wall. In this case, the recess or the cutaway is preferably associated with the plug-and-socket connector body, and the material section which corresponds thereto or the wall which corresponds thereto is preferably associated with the shielding. Of such coding means which correspond to each other, in particular only in one each case or in particular two in each case is/are provided, which following the above example adopt the one or both positions at which the above coding means which correspond to each other are not provided. Preferably such coding means do not take on any explicit fastening tasks for the shielding to/on the plug-and-socket connector body, but it is possible also to configure or to provide these as such.

That is to say, it is preferred for all the coding means which correspond to each other to be provided regularly distributed on the periphery of the receptacle or of the shielding. It is of course also possible to provide a non-regular or only partially regular distribution of certain or all of the coding means which correspond to each other. Preferably a total of eight coding means which correspond to each other is provided, with seven being configured in accordance with the former example of embodiment and one in accordance with the latter example of embodiment. That is to say also that seven fastening regions hold the shielding on the plug-and-socket connector body, on condition that they are formed as such. This effects robust and permanent seating of the shielding on the plug-and-socket connector. Coding means which correspond to each other in this case each yield an individual coding, the codings then being provided correspondingly on a periphery of a pole of the plug-and-socket connector. A different number, in particular an even number, of all the coding means which correspond to each other can of course be used: these may be symmetrically or at least partially non-symmetrically and/or equally spaced apart or at least partially unequally spaced apart.

Preferably the plug-and-socket connector body has a mounting region on/in which a mounting section of the shielding can be fastened. In this case it is preferred for the coding means which correspond to each other to be provided or formed in the mounting region of the plug-and-socket connector body and in the mounting section of the shielding. In particular, the shielding can be fastened on/in the receptacle of the plug-and-socket connector body, with the receptacle, in a preferred first example of embodiment of the coding means which correspond to each other, having at least one coding rib on which an edge of a coding slot of the shielding acts, e.g. by means of internal teeth. This fastens the shielding on/in the plug-and-socket connector body, the coding slots serving as fastening slots, which are seated securely on the coding ribs formed as fastening ribs by means of internal teeth.

In embodiments of the first example of embodiment of the coding means which correspond to each other, the coding slot of the shielding preferably has internal teeth on two edges of the slot which are located opposite each other, which teeth act on two sides of the coding rib which are located opposite each other. In particular such internal teeth guarantee robust and permanent fastening of the shielding on the plug-and-socket connector, in contrast to external teeth, e.g. on contact tabs of the shielding. Instead of internal teeth, in each case only an individual tooth may also be present, or the internal teeth may be replaced by latch means which engage in latch means of the receptacle or of the coding ribs which correspond thereto. Thus e.g. at least one latch hook per coding slot, which can be engaged in a latch recess of the receptacle, is suitable; this may kinematically speaking of course also be embodied the other way round.

As preferred second example of embodiment of the coding means which correspond to each other, the receptacle of the plug-and-socket connector body has a stop on which an end face of a wall of the shielding is seated. A relevant section of the end face of the wall is preferably an end face of the fold in the shielding. This defines a mounting position of the shielding on/in the plug-and-socket connector body in the longitudinal direction of the plug-and-socket connector, the double wall of the fold avoiding damage to the wall upon the mounting of the shielding to/on the plug-and-socket connector body.

For electrical contacting of a continuing shielding, e.g. that of a cable or housing, the shielding of the plug-and-socket connector may have at least one contact tab or contact spring or contact blade remote from its shield section. In this case it is preferred for the contact tab in question to be provided adjacent to a coding means. In particular, the contact tab in question is provided between two coding means of the shielding and extends away from the shielding and also the coding means in the longitudinal direction. In this case, it is further preferred for the contact tabs and coding means of the shielding to alternate reciprocally on a periphery of the shielding. For coding of the plug-and-socket connector with respect to a corresponding plug-and-socket connector, the latter may have a further coding which is preferably provided on/in a collar which is formed or can be mounted on the plug-and-socket connector.

A plug-and-socket connector which preferably corresponds to the electrical plug-and-socket connector according to the invention, also referred to as "mating connector", likewise has a plug-and-socket connector body and electromagnetic shielding provided on the plug-and-socket connector body. The shielding of the mating connector preferably has resilient contact arms or contact arm arrangements for electrical contacting of a shielding of the plug-and-socket connector corresponding to the mating connector. Apart from two or four electrical contact arms or contact arm arrangements of the shielding, the or preferably all the other contact arms or contact arm arrangements on a certain periphery of the shielding are at a substantially identical distance from the contact arms or contact arm arrangements which are directly adjacent in each case.

A contact arm arrangement is to be understood here to mean a grouping of a plurality of preferably resilient contact arms. The respective preferably resilient contact arms, i.e. also those of a contact arm arrangement, may be preferably integrally connected to the shielding in the longitudinal direction on one or on both sides. In the case of a one-sided attachment of the contact arm in question, a longitudinal end section, and in the case of an attachment of the contact arm in question on both sides, a middle section, of the contact arm projects inwards into the shielding or outwards away from the shielding. In the case of an attachment of the contact arms or an arrangement thereof on both sides, these are formed as contact blades or contact blade arrangements, the term "contact arm" being intended to jointly include the term "contact blade" and also the term "contact spring". The contact arms or the contact arm arrangements of the shielding may also be formed separately from the shielding.

An electrical plug-in connection according to the invention consisting of a plug-and-socket connector according to the invention and a plug-and-socket connector which corresponds thereto, which may likewise be a plug-and-socket connector according to the invention, is preferably formed such that the two plug-and-socket connectors can be inserted into one another in only one or in two reciprocal relative positions. The two plug-and-socket connectors are coded correspondingly for this. This ensures that the electrical contact arms or contact arm arrangements of the shielding of the one plug-and-socket connector, e.g. the mating connector, do not contact a fold in the shielding of the plug-and-socket connector which corresponds thereto, which results in the advantages discussed above or avoids the disadvantages discussed above. For this, the corresponding plug-and-socket connector lacks a contact arm or a contact arm arrangement at a corresponding point.

This coding which preferably also serves for insertion, protected against pole reversal, of the two electrical plug-and-socket connectors into one another may be realised in diverse ways. Thus it is e.g. possible to configure a collar of the one plug-and-socket connector correspondingly, e.g. by means of a projection or a recess. A plurality of projections or recesses for a coding can of course be used. The other plug-and-socket connector is then formed which corresponds thereto, and therefore has a recess instead of a projection, or vice versa, at a corresponding point. In this case, this coding may be provided on the plug-and-socket connector body or alternatively on a collar of the second plug-and-socket connector. A plurality of mutual relative positions in which the two plug-and-socket connectors can be inserted into one another can likewise be realised, it being possible for a coding to be omitted or a coding being formed correspondingly between the two plug-and-socket connectors.

BRIF DESCRIPTION OF THE DRAWINGS

The invention will be explained in greater detail below using examples of embodiment with reference to the appended drawings. In the detailed drawings.

DETAILED DECRIPTION

The invention will be explained in greater detail below with reference to a two-pole electrical plug-and-socket connector which is formed as a pin connector. However, the invention is not intended to be limited to such embodiments, but can be applied to all plug-and-socket connectors. Thus it is e.g. possible to form the plug-and-socket connector as a three-pole pin connector. Also, it is of course possible to apply it to an electrical female connector. Although it is preferred to use the plug-and-socket connector according to the invention in power electronics and, in that field, in particular in the hybrid or fuel cell automotive sector, it is of course likewise possible to apply it to pin connectors and/or female connectors for signal or data transmission outside the automotive sector as well.

Figure 1:
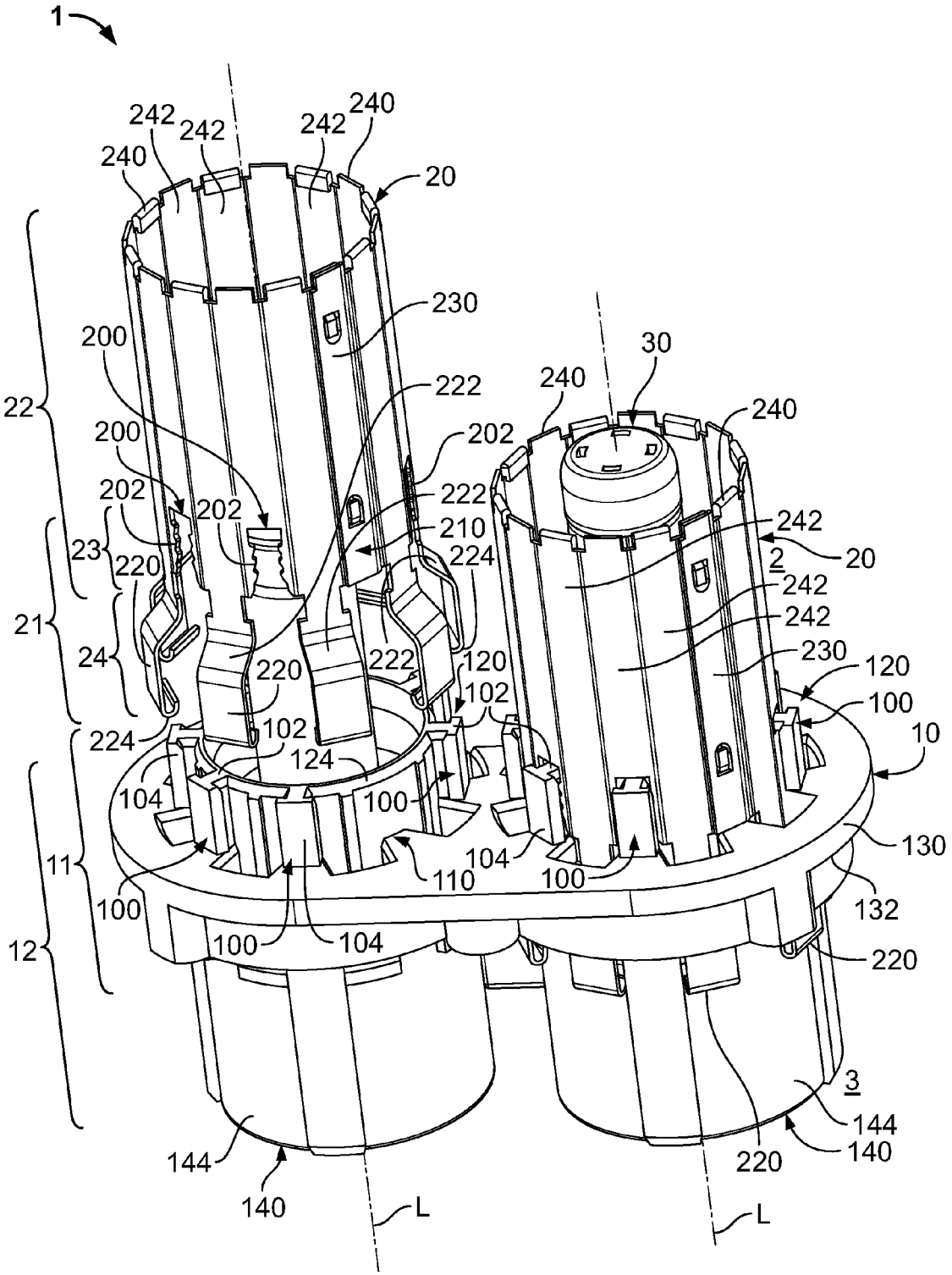
FIG. 1 is a perspective side view of a two-pole electrical plug-and-socket connector according to the invention with a mounted and a not yet mounted electromagnetic shielding according to the invention.

FIG. 1 shows an electrical plug-and-socket connector 1 formed as a pin socket 1, which comprises a plug-and-socket connector body 10, electromagnetic shielding 20, which may also be referred to as screening 20, and an electrical contact means 30 formed in particular as a pin contact 30. The plug-and-socket connector 1 illustrated is a two-pole one, and accordingly exhibits two contact means 30 and two shieldings 20, one shielding 20 being shown in its mounting position on/in the plug-and-socket connector body 10 and the other shielding 20 shortly before its mounting. The plug-and-socket connector 1 has a mounting region 11 for mounting the shielding 20 and a mounting region 12 for mounting the contact means 30.

The mounting region 11 of the plug-and-socket connector body 10 for the shieldings 20 in this case extends from a contact side 2 or front side 2 of the plug-and-socket connector 1 through a baseplate 130 of the plug-and-socket connector body 10 on to a rear side 3 of the plug-and-socket connector 1. Corresponding to the mounting region 11, the shielding 20 has a mounting section 21 preferably integrally starting from a shield section 22, by means of which mounting section the shielding 20 can be mounted on/in the mounting region 11, for which the shielding 20 preferably has a fastening section 23 which is part of the mounting section 21 (see below on this point). A contact section 24 extending away from the fastening section 23 in the longitudinal direction L or along a longitudinal axis L serves for contacting a continuing shielding, the contact section 24 likewise being part of the mounting section 21. In the mounted state of the shielding 20, the contact section 24 extends substantially starting from the baseplate 130 on to the rear side 3 of the plug-and-socket connector 1.

Figure 2:
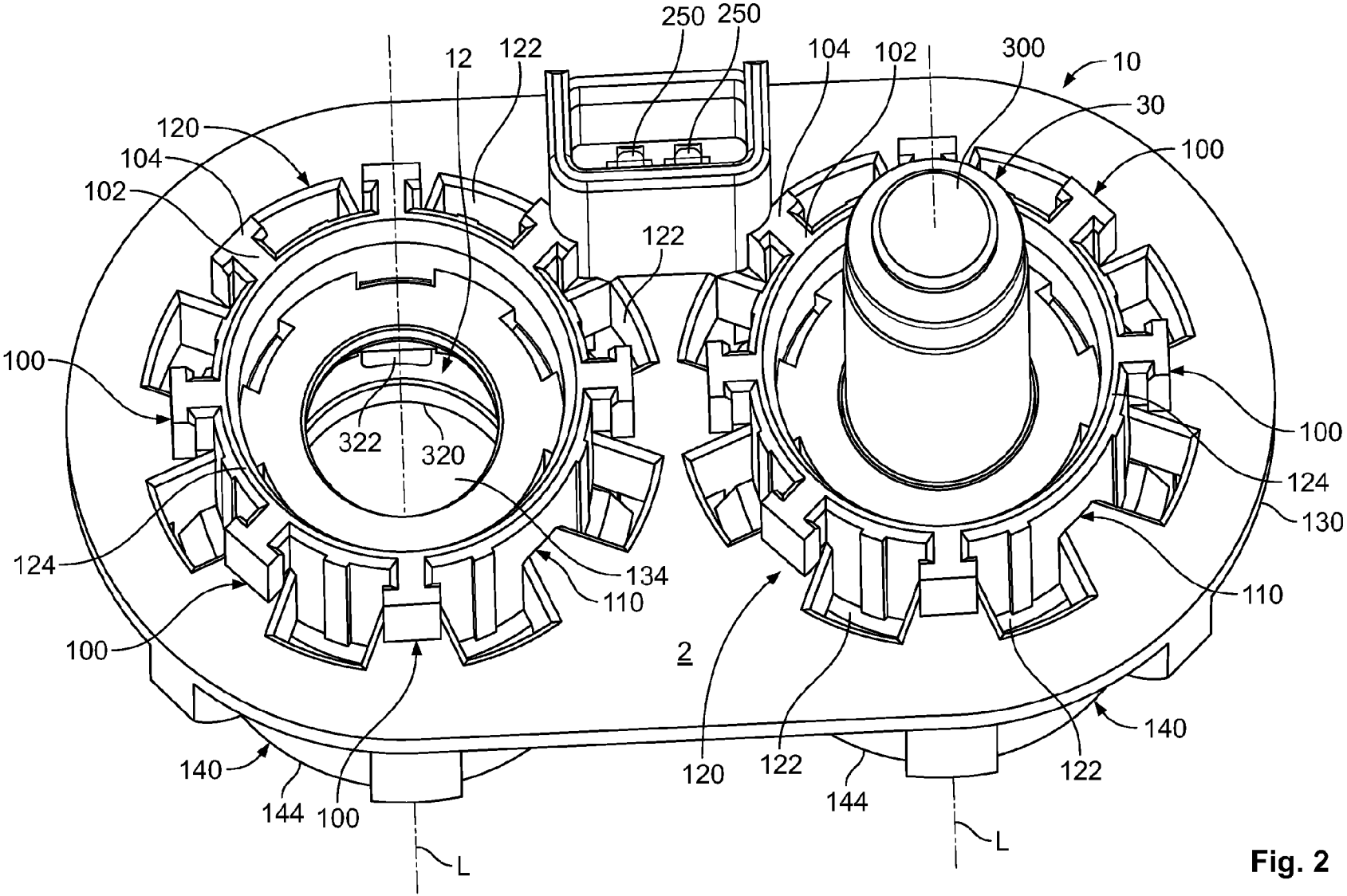
FIG. 2 is a perspective top view of a plug-and-socket connector body according to the invention of the plug-and-socket connector of FIG. 1, with an individual mounted electrical contact means but without shieldings.
Figure 3:
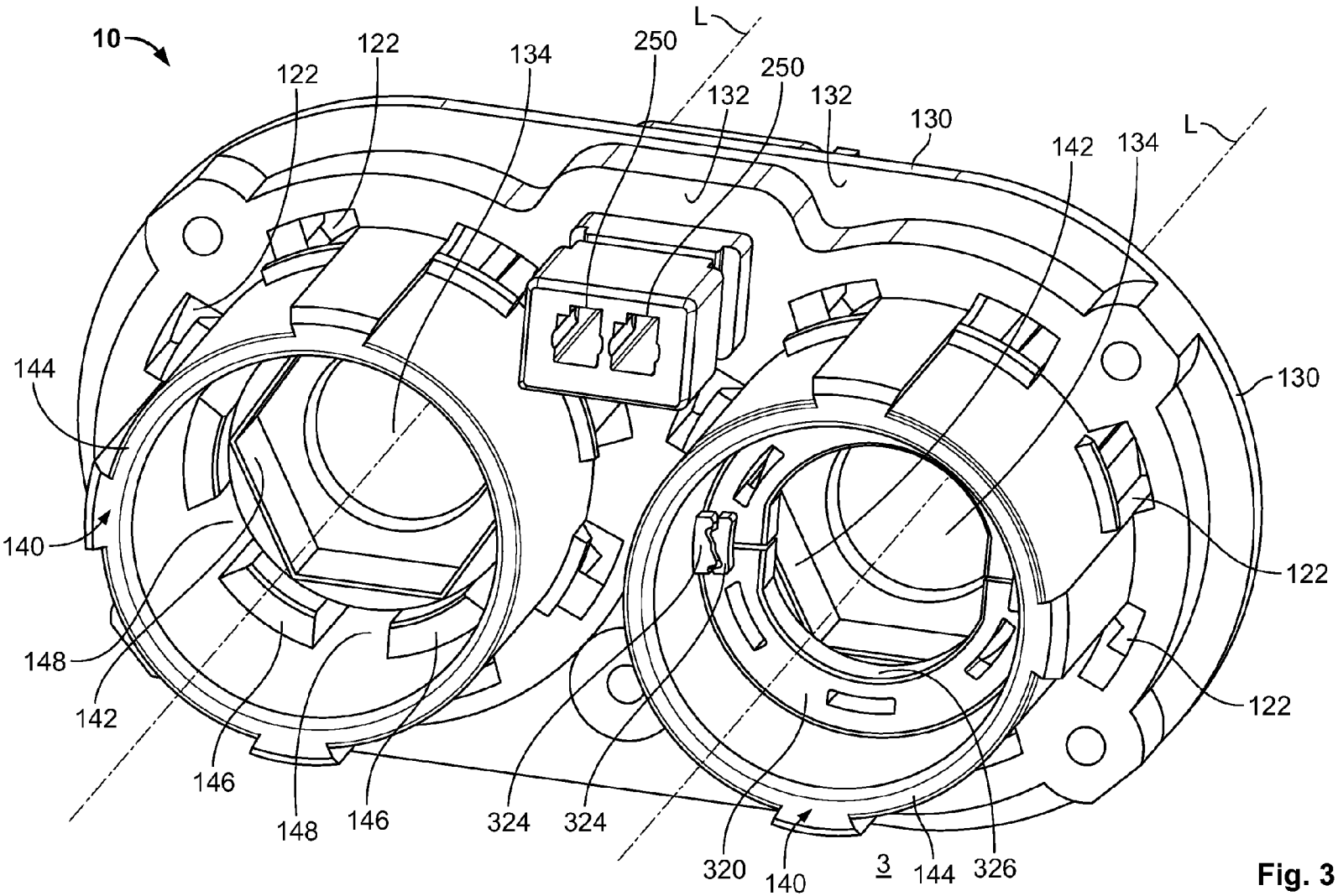
FIG. 3 is a perspective bottom view of the plug-and-socket connector body of FIG. 2, with two mounting clamps in an individual receptacle for a contact means of the plug-and-socket connector.

The mounting region 12 for the contact means 30 extends substantially starting from the level of the baseplate 130 on to the rear side 3 of the plug-and-socket connector body 10; see also FIGS. 2 and 3 on this point. For the fastening in the mounting region 12 of the plug-and-socket connector body 10, the contact means 30 has, starting from an electrical contact section 31, which serves for electrical contacting with an electrical contact means of a mating connector (not shown in the drawings), preferably integrally, a fastening section 32 by means of which the contact means 30 can be fixed in the plug-and-socket connector body 10. Further, the baseplate 130 of the plug-and-socket connector body 10 has a shoulder 132 for a collar to lie on or be mounted on (not shown in the drawings), which shoulder serves for mechanical assembly and optionally also for coding with the mating plug. For this, the collar may be provided externally on the plug-and-socket connector body 10 or be formed integrally therewith.

The electromagnetic shieldings 20 can each be received and mounted in a receptacle 120, which may also be referred to as a shield receptacle 120, of the mounting region 11 of the plug-and-socket connector body 10; see also FIG. 2 on this point. A receptacle 120 for a shielding 20 comprises a plurality of recesses 122 passing through the baseplate 130, which are arranged in a circle in the baseplate 130 and each have a certain distance from each other. Preferably the solid material of the baseplate 130 is present between the through-recesses 122, with, starting from the baseplate 130, a hollow-cylindrical wall 124 which internally adjoins the through-recesses 122 rising in the longitudinal direction L on the front side of the plug-and-socket connector 1.

The hollow-cylindrical wall 124, on its externally provided or formed coding means 100 (see below), and the through-recesses 122 form the receptacle 120 proper. In this case, an inner side of the fastening section 23 of the shielding 20 can be placed externally against the hollow-cylindrical wall 124. Contact tabs 220 extending away from the fastening section 23 in the longitudinal direction L, which substantially form the contact section 24 of the shielding 20, can be received in this case in the through-recesses 122. In the mounted state of the shielding 20, the contact tabs 220 protrude on the rear side 3 of the plug-and-socket connector 1 (see FIG. 1, right-hand shielding 20), where they can electrically contact the continuing shielding of a cable or housing, (not shown in the drawings). Coding means 200 of the shielding 20 finally are seated on the coding means 100 of the plug-and-socket connector body 10 and fasten and orientate the shielding 20 on the plug-and-socket connector body 10.

Figure 4:
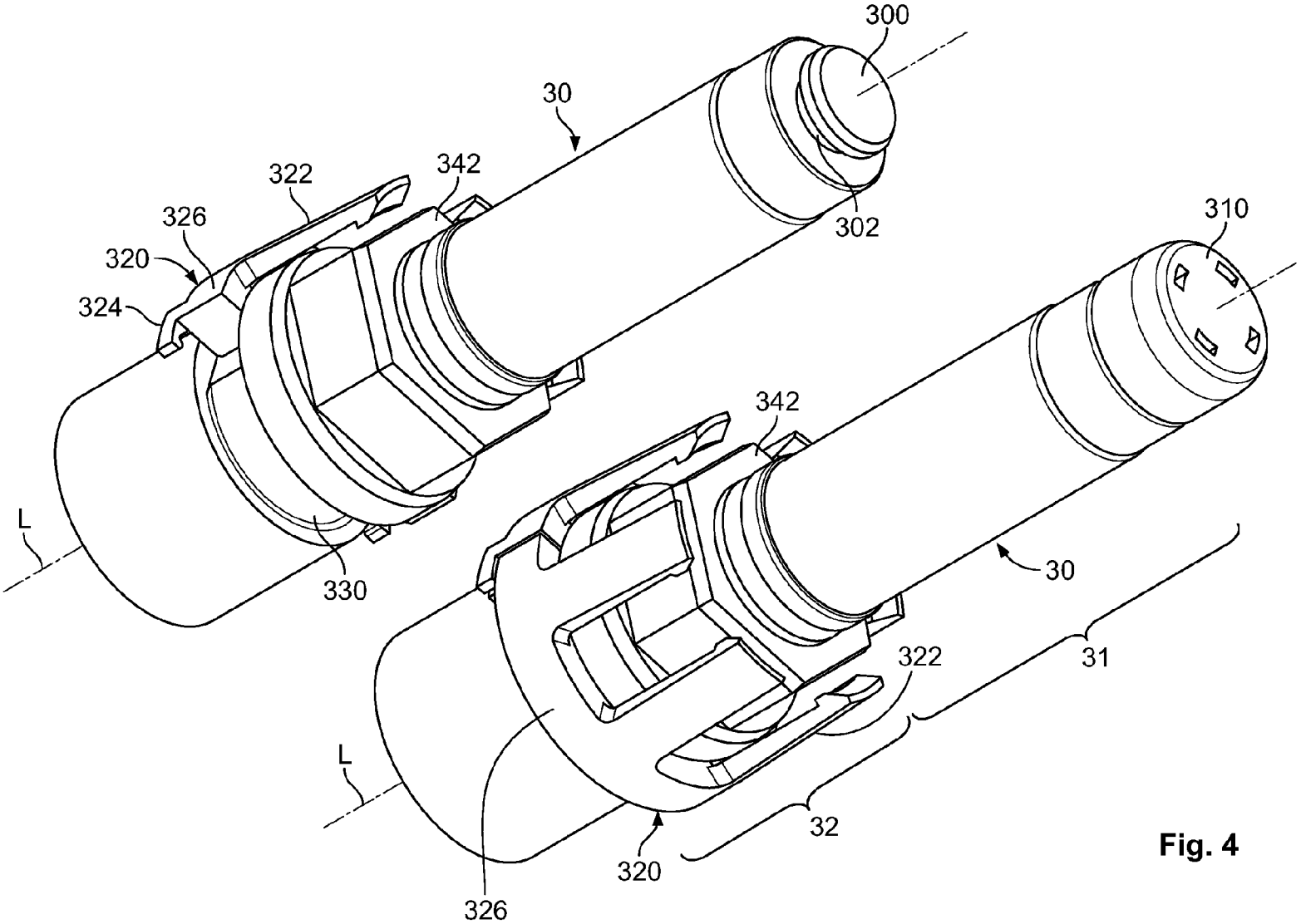
FIG. 4 is a lateral perspective view of two electrical contact means for the plug-and-socket connector, with one or two mounting clamps and no finger protection or with finger protection placed on top.

The electrical contact means 30 can each be received and mounted in a receptacle 140, which may also be referred to as a contact-means receptacle 140, of the mounting region 12 of the plug-and-socket connector body 10; see also FIGS. 3 and 4 on this point. The receptacle 140 has on the rear side 3, starting from the baseplate 130, in the longitudinal direction L of the plug-and-socket connector 1 a hollow-cylindrical wall 144, within which the contact means 30 can be mounted. In this case it is preferred for the through-recesses 122 visible on the rear side 3 to emerge at least in part outside the hollow-cylindrical wall 144. Overall, it is preferred for the hollow-cylindrical wall 124 of the front side 2 and the hollow-cylindrical wall 144 of the rear side 3 to be arranged coaxially to each other, and for an external diameter of the hollow-cylindrical wall 144 to correspond approximately to an external diameter of the hollow-cylindrical wall 124.

A receptacle 140 for a contact means 30 has internally, approximately at the level of the baseplate 130, a recess 142, which is formed corresponding to a profile 342 of an anti-twist means of the contact means 30. This profile 342 is preferably in the form of an edge profile, in particular a square plug or a hexagon. The fastening section 32 of the contact means 30 can be fixed in the receptacle 140, the electrical contact section 31 of the contact means 30 extending through a through-recess 134, which is central with respect to the receptacle 140, in the baseplate 130 on to the front side 2 and thus taking its place within a mounted shielding 20. At its free longitudinal end within the shielding 20, the contact means 30 has a finger protection 310 preferably made of plastics material; see FIG. 4 on this point. For the mounting thereof, the contact means 30 has a head 300 and a recess 302. Inner hooks of the finger protection 310 engage in the recess 302 and mount the finger protection 310 on the contact means 30.

For mounting of the contact means 30 in the receptacle 140, the contact means 30 preferably has an annular recess 330 in its fastening section 32, in which two mounting clamps 320 with in each case one ring section 326 engage; see likewise FIG. 4 on this point. A respective ring section 326 in this case preferably covers approximately 180°, the two ring sections 326 engaging on each other by means of latch hooks 324 formed thereon in each case and holding the mounting clamps 320 on the contact means 30 in the annular recess 330. The contact means 30 can be fastened in the receptacle 140 by means of latch hooks 322 projecting from the ring sections 326, for which purpose the receptacle 140 has internal recesses 148 corresponding to the latch hooks 322.

For this, the contact means 30 equipped with the mounting clamps 320 is advanced into the receptacle 140 in a correct orientation, the profile 342, for securing against twisting, taking its place in the recess 142 of the receptacle 140 and in so doing the latch hooks 322 latching within the receptacle 140 on suitable projections or in suitable recesses (not shown in the drawings). One or a plurality of mounting projections 146 in the receptacle 140 adjacent to points of the ring sections 326 which are accessible from the end face serve(s) to minimise play of the mounted contact means 30 and to centre the contact means 30 upon the mounting thereof.

The coding means 100 of the plug-and-socket connector body 10, which may also be referred to as orientation means for the shielding 20, extend from the solid material of the baseplate 130 between two directly adjacent through-recesses 122 in the longitudinal direction L on the front side of the plug-and-socket connector 1. The coding means 100 are preferably T-shaped in cross-section and are preferably formed integrally with the hollow-cylindrical wall 124. A (coding) rib 102 or a (coding) land 102 of an individual coding means 100 in this case lies against the hollow-cylindrical wall 124 or is connected in one piece therewith in terms of material and finishes radially on the outside with a bar 104 which forms two undercuts between it, two long sides of the coding rib 102 and an outer wall of the hollow-cylindrical wall 124. Regions of the shielding 20 can engage in these undercuts, which regions each form a coding means 200 of the shielding 20.

The coding means 200 of the shielding 20, which may likewise be referred to as orientation means for the shielding 20, are preferably formed in the fastening section 23 of the shielding 20. The coding means 200 in question is preferably located between two contact tabs 220 of the shielding 20, with the fastening section 23 extending in the longitudinal direction L on a space located therebetween on the front side 2 of the plug-and-socket connector 1. Then a coding means 200 formed as a slot-shaped recess or a coding slot 200 or as a groove (not shown in the drawings) is provided in such a part of a wall 240 of the shielding 20. The shielding 20 can be fastened to the plug-and-socket connector body 10 substantially by means of the coding slots 200.

Preferably the respective long edges of the coding slots 200 have inward-directed teeth 202 which can act on the coding ribs 100 of the receptacle 120 for the shielding 20 and thus ensure reliable holding of the shielding 20 on the plug-and-socket connector body 10. A run-in slope on one open side of the respective coding slot 200 or groove simplifies the mounting of the shielding 20 on the plug-and-socket connector body 10. A groove for coding is preferably constructed similarly to a coding slot 200, except that said groove then closes the shielding 20 on an outer periphery. That is to say also that the respective bar 104 of the coding ribs 100 is missing and the groove surrounds the respective coding rib 100.

In this case, the respective relevant coding means 100, 200 of the plug-and-socket connector body 10 and the shielding 20 are generally corresponding to one another, i.e. are formed like a positive and a negative or are designed according to the key/lock principle. According to the invention, a plurality of configurations which bring this about are conceivable, preferred ones having already been explained above. Thus lands or projections may be further used as coding means 100 of the plug-and-socket connector body 10, and recesses or through-recesses as coding means 200 of the shielding 20. This may kinematically speaking also be the other way round.

Further, an individual variation of the dimensions or forms of the relevant corresponding coding means 100, 200 is possible in order to achieve a desired coding. Furthermore, a different number or different distances, which effect a more or less symmetrical distribution of the coding means 100, 200 which correspond to each other in each case, may be used for the coding. This also applies to the corresponding coding means 110, 210 discussed below (if they are regarded as such), as long as a clear orientation of the shielding 20 relative to the plug-and-socket connector body 10 is possible.

An orientation or a positioning of the shielding 10 by means of a coding 100/200 or a plurality of codings 100/200, i.e. by means of two or an even-numbered plurality of coding means 100, 200, preferably takes place in order to impart a desired position with respect to the plug-and-socket connector body 10 to a fold 230 in the shielding 20. The shield section 22 of the shielding 20 in this case is preferably constructed from substantially elongate, preferably rectangular facets 242, with the fold 230 being provided in a facet 242, and the coding means 200 or fastening means alternating with facets 242 on which contact tabs 220 are provided in or on the other facets 242.

A contact tab 220 in this case is preferably as wide as a facet 242, the contact tab 220 preferably tapering in the transition to the facet 242. Other configurations of the shielding 20 or of the shield section 22 can of course be used. In the longitudinal direction L after this taper, the contact tab 220 preferably has a bent-up section 222 to the outside, in order to make space to the inside for the continuing shielding and a latch hook 224 located on the contact tab 220, which hook is preferably bent inwards and can electrically contact the continuing shielding there. Further, the plug-and-socket connector body 10 may preferably have separate electrical connectors 250 for fuses (see FIGS. 2 and 3).

A mating connector (not shown in the drawings) can be placed on top of the plug-and-socket connector 1 according to the invention, which mating connector electrically contacts the shielding 20 of the plug-and-socket connector 1 preferably by means of contact arms or contact arm arrangements of its shielding. In this case, owing to the double wall of the fold 230, it is not desired for the shielding of the mating connector to contact the fold 230. The mating connector lacks the relevant contact arms or contact arm arrangements at least at a corresponding point for this. Preferably the shielding of the mating connector is formed such that it electrically contacts the shielding 20 of the plug-and-socket connector 1 according to the invention on only every second facet 242, a coding of the plug-and-socket connector 1 with that of the mating connector, and also a coding of the shielding 20 on the plug-and-socket connector body 10 having to be selected correspondingly.

On condition of a symmetrical distribution of the codings 100/200, in a preferred embodiment of the invention the coding means 100, 200 are omitted at least one point on the periphery of the receptacle 120 of the plug-and-socket connector body 10 or of the periphery of the shielding 20. That is to say that, of a given number of codings 100/200, which are at the same peripheral distance with respect to their common periphery, two are at a greater distance from each other, in particular double the distance. This may also apply to several codings 100/200. It is however possible, according to the invention, to use exclusively codings 100/200, which then however may not all be provided with the same peripheral distance from each other.

That is to say, depending on how the matter is looked at, here a coding 100/200 is omitted or another coding 110/210 arranged. It must only not be possible for the shielding 20 to be able to be fastened to/on the plug-and-socket connector body 10 in an incorrect orientation. If this is regarded as another coding 110/210, this in turn has a coding means 110 which is formed corresponding to a coding means 210. The coding means 110 of the plug-and-socket connector body 10 is then e.g. a recess 110, cutaway 110 or a stop 110, whereas the coding means 200 of the shielding 20 is e.g. a section 210 or region 210 of the fold 230, a material section 210, a wall 210 or an end face 210 of a wall 240 or of the fold 230 of the shielding 20.

According to the invention, incorrect orientation or alignment of the shielding 20 can be avoided in the case of screen plates with an inward-directed press-in fastening and a fold 230. This is achieved according to the invention preferably with coding slots 200, arranged non-symmetrically on the periphery of the shielding 20, with interference-fit teeth 202 which are positioned and oriented by means of a certain receptacle geometry in the plug-and-socket connector body 10, which makes it possible to avoid incorrect orientation or alignment of the fold 230.

The invention claimed is:

1. An electrical plug-and-socket connector, comprising:

a plug-and-socket connector body and electromagnetic shielding provided on the plug-and-socket connector body, the plug-and-socket connector body comprising a baseplate having through recesses, and the shielding having contact tabs projecting through the through recesses and positioned on an opposite side of the baseplate, wherein the plug-and-socket connector body and the shielding have coding means which correspond to each other, by means of which the shielding is provided in a given orientation on the plug-and-socket connector body, wherein the coding means are a coding rib or a projection, and a coding slot or a groove, and the coding rib or the projection is preferably provided on the plug-and-socket connector body, and the coding slot or the groove which corresponds thereto are preferably provided in the shielding.

2. The electrical plug-and-socket connector according to claim 1, wherein the coding means correspond to each other effect fastening of the shielding to the plug-and-socket connector body, and preferably the coding means which correspond to each other are arranged such that a fold in the shielding has a certain orientation relative to the plug-and-socket connector body, with preferably only a single orientation, or a plurality of orientations of the shielding which are point-symmetrical or mirror-symmetrical to each other relative to the plug-and-socket connector body are possible.

3. A made-up electric cable, in particular for the automotive sector, with a preferably two-pole or three-pole electrical plug-and-socket connector, wherein the plug-and-socket connector is constructed according to claim 1.

4. The electrical plug-and-socket connector according to claim 1, wherein the coding rib is positioned intermediate two through slots.

5. The electrical plug-and-socket connector according to claim 1, wherein the through slots are arranged in a generally circular pattern.

6. An electrical plug-and-socket connector, comprising:

a plug-and-socket connector body and electromagnetic shielding provided on the plug-and-socket connector body, wherein the plug-and-socket connector body and the shielding have coding means which correspond to each other, by means of which the shielding is provided in a given orientation on the plug-and-socket connector body, and wherein the coding means which correspond to each other are a recess or a cutaway and a material section or a wall, and the recess or the cutaway is preferably associated with the plug-and-socket connector body, and the material section which corresponds thereto or the wall which corresponds thereto are preferably associated with the shielding, and wherein the shielding is fastened on/in a receptacle of the plug-and-socket connector body, with the receptacle having at least one coding rib, on which at least one edge of a recess in the shielding acts, the shielding being mounted on/in the plug-and-socket connector body, with preferably two edges of the recess which are located opposite each other act on two long sides of the coding rib which are located opposite each other, preferably by means of internal teeth.

7. The electrical plug-and-socket connector according to claim 6, wherein the plug-and-socket connector body has a mounting region on/in which a mounting section of the shielding is fastened, and the coding means which correspond to each other are provided or formed in the mounting region of the plug-and-socket connector body and in the mounting section of the shielding.

8. The electrical plug-and-socket connector according to claim 6, wherein the plug-and-socket connector body and the shielding in each case have a plurality of coding means which are arranged distributed in the peripheral direction of the receptacle or the shielding, with the respective coding means, apart from two or four coding means in each case, have a substantially identical peripheral distance from the respective directly adjacent coding means.

9. An electrical plug-and-socket connector, comprising:

a plug-and-socket connector body and electromagnetic shielding provided on the plug-and-socket connector body, wherein the plug-and-socket connector body and the shielding have coding means which correspond to each other, by means of which the shielding is provided in a given orientation on the plug-and-socket connector body, wherein the coding means are a coding rib or a projection, and a coding slot or a groove, and the coding rib or the projection is preferably provided on the plug-and-socket connector body, and the coding slot or the groove which corresponds thereto are preferably provided in the shielding, and wherein a receptacle of the plug-and-socket connector body has a stop on which one end face of a wall of the shielding is seated, whereby a mounting position of the shielding on/in the plug-and-socket connector body in the longitudinal direction of the plug-and-socket connector is defined, and the end face of the wall of the shielding is preferably an end face of the fold in the shielding.

10. An electrical plug-and-socket connector, comprising:

a plug-and-socket connector body and electromagnetic shielding provided on the plug-and-socket connector body, wherein the plug-and-socket connector body and the shielding have coding means which correspond to each other, by means of which the shielding is provided in a given orientation on the plug-and-socket connector body, wherein the coding means are a coding rib or a projection, and a coding slot or a groove, and the coding rib or the projection is preferably provided on the plug-and-socket connector body, and the coding slot or the groove which corresponds thereto are preferably provided in the shielding, and wherein the shielding has at least one contact tab being arranged adjacent to a coding means, preferably between two coding means of the shielding, and preferably contact tabs and coding means alternating on the periphery of the shielding.

11. An electrical plug-and-socket connector, comprising:

a plug-and-socket connector body and electromagnetic shielding provided on the plug-and-socket connector body, wherein the plug-and-socket connector body and the shielding have coding means which correspond to each other, by means of which the shielding is provided in a given orientation on the plug-and-socket connector body, and wherein the plug-and-socket connector has a coding for a plug-and-socket connector corresponding to the plug-and-socket connector or mating connector, the coding preferably being provided on/in a collar of the plug-and-socket connector.

* * * * *